United States Patent [19]

Clancy

[11] 4,348,852

[45] Sep. 14, 1982

[54] METHOD AND APPARATUS FOR PACKAGING LOOSE MATERIAL

[75] Inventor: David Clancy, Canaan, Conn.

[73] Assignee: Colgate-Palmolive Company, New York, N.Y.

[21] Appl. No.: 840,093

[22] Filed: Oct. 6, 1977

Related U.S. Application Data

[63] Continuation of Ser. No. 521,771, Nov. 7, 1974, abandoned.

[51] Int. Cl.[3] ..... B65B 1/04

[52] U.S. Cl. ..... 53/469; 53/570; 141/1; 141/129; 141/183; 222/55

[58] Field of Search ..... 53/29, 183, 187, 473, 53/266 R, 469, 570; 141/1, 10, 114, 129, 131, 155, 166, 167, 183–191, 376; 198/572; 177/16, 119–121; 222/55, 59, 63

[56] References Cited

U.S. PATENT DOCUMENTS

| | | | |
|---|---|---|---|
| 2,623,676 | 12/1952 | Baker et al. | 141/131 |
| 3,679,010 | 7/1972 | Bullivant | 222/55 X |
| 3,812,649 | 5/1974 | Clancy | 53/187 |
| 3,870,169 | 3/1975 | Kojima | 198/572 X |

*Primary Examiner*—Frederick R. Schmidt
*Attorney, Agent, or Firm*—LeBlanc, Nolan, Shur & Nies

[57] ABSTRACT

A Method and Apparatus for automatically packaging granular or powdered material in envelopes wherein a belt supported horizontal column of material of uniform cross section is intermittently advanced longitudinally toward an envelope filling station in such equal increments that during each advance a leading end column section of predetermined volume falls into an envelope newly positioned at said station.

14 Claims, 5 Drawing Figures

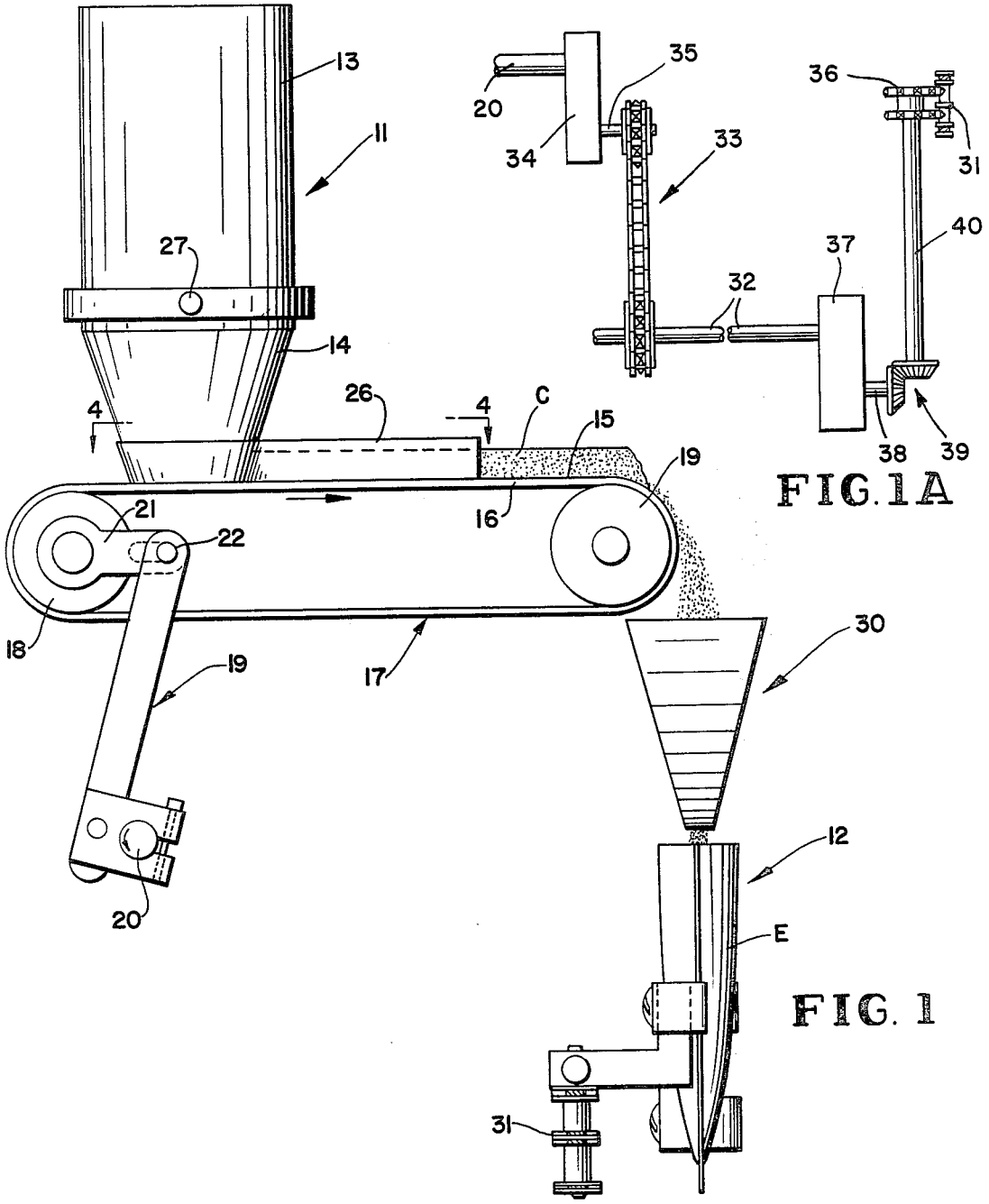
FIG. 1A
FIG. 1
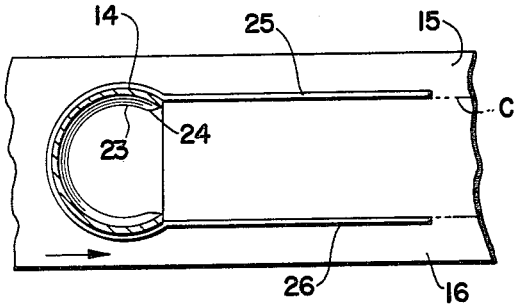
FIG. 4

METHOD AND APPARATUS FOR PACKAGING LOOSE MATERIAL

This is a continuation of Ser. No. 521,771, filed Nov. 7, 1974, now abandoned.

This invention relates to a method and apparatus for automatically packaging loose particulate material such as detergent material in granular or powdered relatively dry state and particularly to a structurally simple and inexpensive mode of depositing predetermined volumes of said material in successive envelopes or like receptacles in automatic machinery.

More particularly, as will be ascertained from the description of the preferred embodiment, the invention is concerned with metering and depositing charges of loose detergent or the like in granular and/or powder form, each charge being for example in the order of about 0.15 ounces, in individual preformed open envelopes as the envelopes are successively positioned at a filling station, and an advantageous feature of the invention is that this is accomplished rapidly and accurately without the use of valves or complex measuring or weighing devices.

Another advantageous feature of the invention is that it provides a generally horizontal column of the loose material that is periodically intermittently moved a predetermined distance to separate from the leading end during each advance the desired predetermined amount of material. In specific accomplishment of this advantage the column is formed on a moving conveyor, such as a belt, and each advance of the conveyor allows a predetermined amount of the material to separate and drop by gravity from the leading end of the column into an envelope positioned below it.

Further details and advantages of the invention will appear as the description proceeds in connection with the appended drawings and the annexed claims.

THE INVENTION RELATIVE TO KNOWN PRIOR ART

Automatic machines for depositing metered charges of loose material in preformed envelopes, packets, bags or other containers have long been known. The expired patent to Bartelt U.S. Pat. No. 2,649,674 discloses an early automatic packaging machine of the type related to the invention, wherein individual envelopes are formed from a web of plastic, paper or the like, successively positioned to receive the desired contents and then sealed.

The patents to Schulze et al U.S. Pat. No. 3,708,952 and Harker U.S. Pat. No. 2,745,583 disclose automatic machinery wherein powdered or granular material is metered by special devices at the bottom of a hopper for delivery into receptacles positioned in turn at a filling station. The Invention is concerned with this type of machine which prior to the invention mainly included relatively complex valving devices for depositing the charges of material into the successive envelopes. The advantageous feature of invention to be later described in full detail eliminates complex valving devices and their controls and provides for deposit of material in a continuous horizontal column on the top flight of an intermittently drive belt conveyor, with each advance of the conveyor moving the column to a position where the leading end section of the column drops off by gravity into the envelope positioned below.

The concept of filling containers from the leading end of a column of material deposited by a hopper on the upper flight of a continuously moving belt conveyor is generally known as disclosed in Esval U.S. Pat. No. 2,992,625; and the patent to Lea U.S. Pat. No. 1,840,455 discloses an intermittent sampling belt conveyor deriving a column of granular material from a hopper side opening.

The invention herein distinguishes essentially over the content and state of the art represented by the foregoing in that it provides controlled predetermined intermittent movement of the material column in synchronism with envelope or like receptacle positioning, so that successive equal volumes from the leading end of the column separate with each intermittent advance and drop into envelopes correspondingly positioned below, and this is a major advantageous feature of the invention.

BRIEF DESCRIPTION OF THE DRAWINGS

FIG. 1 is a side elevation, partly diagrammatic, showing the invention according to a preferred embodiment;

FIG. 1A is a schematic view showing one system for snychronizing intermittent movement of parts shown in FIG. 1;

FIG. 4 is a fragmentary view partly in section on line 4—4 of FIG. 2 showing powder feeding and guiding arrangement.

PREFERRED EMBODIMENTS

Figures 2, 3:
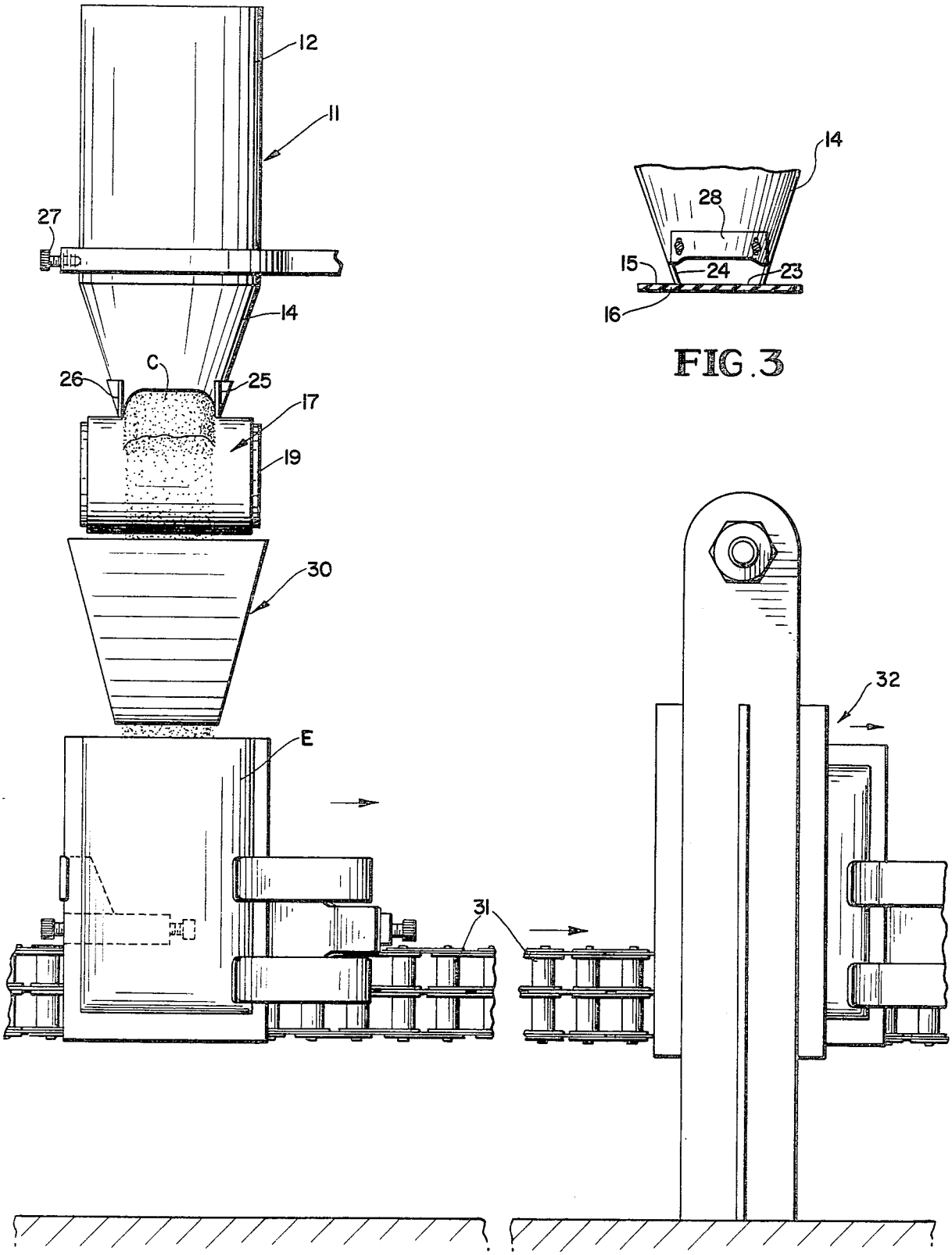
FIG. 2 is a front end elevation.
FIG. 3 is fragmentary end elevation showing the dispensing opening in the lower end of the feed hopper.

Referring to FIG. 1 an automatic machine for filling envelopes with a detergent powder or powder-like particles comprises essentially a detergent material supply and feed supply 11 and an associated envelope forming and positioning section 12.

The material to be packaged is supplied from a hopper 13 that has a reduced size conical lower end 14 terminating just above the upper surface 15 of the horizontal upper flight 16 of an endless conveyor belt 17 supported on rotatable drums 18 and 19.

Drum 18 is intermittently rotated for equal periods sufficient to advance belt surface 15 to the right in FIG. 1 a predetermined distance during each period. A motion transmitting crank mechanism 19 is shown connected between a powered suitably intermittently actuated shaft 20 and an unidirectional ratchet drive 21 for drum 18, although any conventional mechanism for intermittently rotating drum 18 may be used. As shown at 22 crank mechanism 19 may be adustable for the purposes of varying the imparted stroke and the degree of rotation of drum 18 and therefore the extent of advance surface 15 during each envelope fill period as will appear.

The lower end of the hopper terminates in a bottom opening 23 (FIGS. 3 and 4) of a diameter or lateral extent that is appreciably less than the width of the belt surface 15. At the front edge of opening 23, the side wall of the hopper is cut away to provide a downwardly open arch-shaped aperture 24 which faces forwardly in the direction of movement of belt surface 15.

A column forming guide in the form of a strap of sheet metal secured around the lower end of the hopper except for forwardly facing aperture 24, has parallel sides 25 and 26 just above the belt surface 15 and level with the edges of opening 23.

The particulate material discharges by gravity from the hopper through opening 23 and aperture 24. In effect the material is deposited on the belt through opening 23, and aperture 24 essentially determines the cross sectional shape of the horizontal column forming along the surface 15 during each belt movement. Guides 25 and 26 aid aperture 24 in confining the material and determining the column cross section, and by the time the column nears the right hand end of the belt surface 15 in FIG. 1 it has constant width and a predetermined uniform maintained cross section as shown in FIG. 2.

Two adjustments are preferably provided for controlling deposit of the material in surface 15. One adjustment is indicated at 27 in FIG. 2 whereby the hopper assembly may be vertically adjusted to regulate the vertical spacing between its open lower end and the relatively moving belt surface. In practice it is preferable to locate the lower edge of hopper opening 23 as close as possible to belt surface 15 although not in contact, so that all of the material flows out through aperture 24 and none escapes laterally between the belt and the edges of the opening. The other adjustment is in the form of a vertically adjustable aperture edge plate 28 (FIG. 3) at the upper edge of aperture 24. This controls the amount of material and the shape in the column cross section.

Either or both of these two adjustments correlated with adjustment of the extent of each linear movement of belt surface 15 may be effected to determine the exact volume of material discharged into each envelope during each advance of the column toward the filling station indicated at 30.

Referring to FIGS. 1 and 2 the filling station is illustrated only diagrammatically as comprising a fixed funnel or guide 30 positioned below the forward end of the belt to receive the material that drops off the belt during each intermittent advance.

Receptacles in the form of open top envelopes E are mounted in spaced relation on an endless intermittently advanced chain 31 which is suitably actuated to position successive envelopes below funnel 30 in timed relation with belt movement to receive the material that has dropped off the end of the conveyor during each advance.

The invention is peculiarly applicable to machines of the type disclosed in the patent to Clancy U.S. Pat. No. 3,812,649 wherein envelopes are formed from a continuous web of envelope material and individual envelopes after forming are attached to clips in an endless chain which is intermittently advanced to locate the empty open top envelopes in succession at a filling station.

The envelopes E are preferably formed from a web, attached to chain 31 and advanced in turn to the filling station as disclosed in said Clancy patent to which reference is made for any required detail as to envelope forming and positioning. As shown in said Clancy patent each envelope is then closed, as indicated in the drawing herein at 32 in FIG. 2.

A typical mode of synchronizing actuation of belt 17 and chain 31 to obtain the foregoing timed relation of product and receptacle movements is shown in FIG. 1A. A continuously rotated main power shaft 32 is connected to shaft 20 by a chain drive system 33 and a gear box 34 containing mechanism for changing continuous rotation of input shaft 35 to intermittent rotation of output shaft 20. Power shaft 32 is also connected to drive a sprocket 36 meshed with chain 31 through a gear box 37 having an intermittently rotated output shaft 38, connected to sprocket 31 by bevel gearing 39 and shaft 40. It will be understood that the specific structure shown in FIG. 1A is illustrative only and does not comprise part of the invention, and that other synchronization means such as related electrical or hydraulic drives may be used.

In operation the material in the hopper assembly discharges by gravity onto the belt flight surface 15. During the dwell periods of the belt between the increments of advance, that is while the filled envelope is being replaced with a fresh empty envelope at the filling station, flow of material from the hopper assembly is effectively blocked by the material on the stationary belt. During movement of the belt the particulate material deposits from the hopper assembly as the trailing end of the horizontal column on the belt surface 15. Thus although the belt is intermittently advanced the column C is continuous.

The column C is of substantially uniform cross sectional area. With each equal intermittent advance of belt surface 15, the same length section of the leading end of the column falls off the front end of the conveyor (FIG. 1) through the chute into the envelope positioned at the filling station thereby depositing a predetermined volume of material in each envelope.

The above described adjustments may be made to obtain accurate synchronism of belt and envelope movements; to adapt for different specific gravity particulate materials; and to regulate the volume deposited upon each belt movement.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of automatically packaging relatively loose particulate material in substantially uniform volumetric amounts in a series of receptacles such as envelopes comprising the steps of providing a supported generally horizontal column of said material of substantially uniform lateral cross section, intermittently advancing said column longitudinally in equal increments of advance spaced by dwell periods toward an envelope filling station while positioning in predetermined succession a series of spaced open-top envelopes to be filled at said station in stationary condition and in such sequential timed relation that during each advance a leading section of predetermined volume falls from the end of said column into an envelope being maintained in position at said station, and after each envelope has received its predetermined volume of material from said column moving that envelope to a station wherein the top thereof is closed.

2. The method defined in claim 1, wherein empty envelopes are moved into filling position in said station during said dwell periods.

3. Apparatus for automatically packaging relatively loose particulate material in substantially uniform volumetric amounts in a series of receptacles such as envelopes or the like comprising means defining a filling station, means defining a generally horizontally movable support, means for intermittently moving said support in equal increments toward said filling station, means depositing said material on said support in such association with said support as to provide a supported generally horizontal continuous column of said material of substantially uniform lateral cross section intermittently movable in equal increments of advance toward said filling station upon actuation of said support moving means, means operated in timed relation with said means for intermittently moving said support for locating a series of spaced envelopes in stationary position in succession at said station with their tops open and in such sequential timed relation that during each said increment of advance of said column only a leading end section of predetermined volume falls from the leading end of said column into an envelope maintained in position in said station, and means for closing the top of each envelope after it receives said predetermined volume of said material.

4. Apparatus as defined in claim 2, wherein means is provided for varying said lateral cross-section of said column.

5. Apparatus as defined in claim 3, wherein means is provided for varying the degree of each increment of advance of said column.

6. Apparatus as defined in claim 3, wherein said support comprises an endless conveyor belt and said column is supported on the horizontal upper flight of said endless conveyor belt, and means is provided for intermittently moving said belt for effecting said incremental advance of said support.

7. Apparatus as defined in claim 6, wherein said means for depositing said material comprises material supply means disposed above said upper conveyor belt flight open at its lower end for gravity discharge of material upon said upper flight of the belt to form the trailing end of said column during belt movement.

8. Apparatus as defined in claim 7, wherein said material supply means is a hopper assembly having a bottom opening just above the surface of said upper belt flight and a foward opening metering the passage of material forming said column.

9. Apparatus as defined in claim 8, wherein means is provided for adjusting the size of said forward opening.

10. Apparatus as defined in claim 8, wherein said hopper assembly includes means for adjusting the vertical spacing between said bottom opening and the belt surface.

11. Apparatus as defined in claim 8, wherein side guide means extending forwardly from the hopper assembly at said forward opening confines the lateral extent of said column.

12. Apparatus for automatically packaging a substantially uniform predetermined quantity of dry particulate material in each of a series of envelopes comprising means defining a filling station, means providing a spaced succession of empty open top envelopes and positioning said envelopes in turn in stationary condition at said filling station, and means operated in synchronism with said envelope positioning means for depositing only a predetermined quantity of said material in each successive envelope comprising means defining a generally horizontally movable support, means for intermittently moving said support in equal increments of advance toward said filling station, means for depositing said material on said support in such association with said support as to provide a generally horizontal continuous column of said material of substantially uniform lateral cross section intermittently longitudinally movable toward said filling station in predetermined increments of advance to permit only the predetermined quantity of material to fall from the leading end of said column with each advance, means at said station for directing material falling from the leading end of said column into an empty envelope maintained positioned at said station, and means for closing each envelope in turn after receiving said predetermined quantity of material.

13. A method of introducing into each of a spaced succession of envelopes only substantially the same predetermined weight of flowable particulate material which comprises successively positioning envelopes having closed bottoms and sides and open tops in stationary condition at a filling station, continually forming at one end of a forming station a horizontally movable supported column of such material of substantially uniform lateral cross section, intermittently moving said column longitudinally away from said end of the forming station and toward said filling station in predetermined equal increments of advance to periodically place the leading end of said moving column in unsupported position over said filling station whereby to drop only said predetermined weight of particulate material from said leading end into an envelope maintained in position at said filling station, and coordinating the positioning of said envelopes with the movements of said column so that each envelope receives only said predetermined weight of particulate material and is then moved out of said filling station, and then moving each envelope from said filling station to an envelope top closing station.

14. Apparatus for introducing into each of a succession of envelopes only substantially the same predetermined weight of flowable particulate material which comprises means providing a filling station, means for continually positioning envelopes having closed bottoms and sides and open tops in succession in stationary condition at said filling station, means for continually forming at one end of a forming station a horizontally movable continuous support column of such material of substantially uniform lateral cross section, means operated in relation with said envelope positioning means for intermittently moving said column longitudinally away from said end of the forming station and toward said filling station in predetermined equal increments of advance to place only a predetermined weight of particulate material at the leading end of the column of material in unsupported position over said filling station whereby to drop all of said unsupported particulate material from said leading end into an envelope maintained in position at said filling station during each advance of said column, said positioning of said envelopes being so synchronized with the movement of said column that each envelope receives only said predetermined weight of said particulate material and is then moved out of said filling station, and means effective after a filling operation for moving each envelope in turn to an envelope closing station.

* * * * *

UNITED STATES PATENT AND TRADEMARK OFFICE

CERTIFICATE OF CORRECTION

PATENT NO. : 4,348,852

DATED : September 14, 1982

INVENTOR(S) : David Clancy

It is certified that error appears in the above—identified patent and that said Letters Patent is hereby corrected as shown below:

Claim 4, line 1, change "2" to --3--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*